US011617462B2

(12) United States Patent
Peng

(10) Patent No.: US 11,617,462 B2
(45) Date of Patent: Apr. 4, 2023

(54) WASHABLE STRAW OF HIGH PRACTICALITY

(71) Applicant: Kean Research and Innovation (Shenzhen) Co., Ltd, Guangdong (CN)

(72) Inventor: Pandian Peng, Guangdong (CN)

( * ) Notice: Subject to any disclaimer, the term of this patent is extended or adjusted under 35 U.S.C. 154(b) by 0 days.

(21) Appl. No.: 16/889,754

(22) Filed: Jun. 1, 2020

(65) Prior Publication Data

US 2021/0093111 A1 Apr. 1, 2021

(30) Foreign Application Priority Data

Sep. 29, 2019 (CN) ..... 201921643227.2

(51) Int. Cl.
*A47G 21/18* (2006.01)

(52) U.S. Cl.
CPC ..... *A47G 21/18* (2013.01)

(58) Field of Classification Search
CPC ..... A47G 21/18; A47G 21/185; F16L 21/00; F16L 21/005; F16L 21/007; F16L 21/06; F16L 9/17; F16B 7/0413; B21D 39/037; E21B 43/106
See application file for complete search history.

(56) References Cited

U.S. PATENT DOCUMENTS 2,782,805 A * 2/1957 Leadbetter ..... F16L 9/17 138/168
2018/0160831 A1* 6/2018 Yoo ..... A47G 21/18
2020/0069094 A1* 3/2020 Tsai ..... A47G 21/18
2020/0214485 A1* 7/2020 Ng ..... A47G 21/18

FOREIGN PATENT DOCUMENTS

DE 202018106851 U1 * 12/2018 ..... A47G 21/18

* cited by examiner

*Primary Examiner* — Tuongminh N Pham

(57) ABSTRACT

The present disclosure provides a washable straw of high practicality, including a middle connecting body, a first snap-fitting body connected with one side of the middle connecting body, and a second snap-fitting body connected with another side of the middle connecting body opposite to the first snap-fitting body. The first snap-fitting body and the second snap-fitting body are movably connectable by snap-fitting. The structural design of the present disclosure is rational. Through the control of the dimensions of the various components and the elastic contraction of the material, a reliable connection and a certain degree of sealing and leak-proof effect can be achieved. Moreover, it is easy to use and wash, and has an outstanding result of application.

6 Claims, 6 Drawing Sheets

WASHABLE STRAW OF HIGH PRACTICALITY

CROSS REFERENCE TO RELATED APPLICATIONS

The present application claims the benefit of Chinese Patent Application No. 201921643227.2 filed on Sep. 29, 2019, the contents of which are incorporated herein by reference in their entirety.

TECHNICAL FIELD

The present disclosure relates to the technical held of straw products, d more particularly to a washable straw of high practicality, which has a rational structural design and is easy to use.

BACKGROUND TECHNOLOGY

Straws are relatively common products in people's daily life. Their main role is to facilitate the sucking and drinking of a liquid. However, the current widely used straw products are generally for one-time use. It does not only cause a huge waste of resources, but it is also not beneficial to green environmental protection. The wasted straws will lead to pollution to the nature.

How to improve the reusability of straws and facilitate fast cleaning after using for one time is a problem that a technical person in the art would often consider. A large number of research and development and experiments on the structure of straws have been carried out, and good results have been achieved.

SUMMARY

In order to overcome the existing technology problem, the present disclosure provides a washable straw of high practicality, which has a rational structural design and is easy to use.

The scheme for solving the technical problem by the present disclosure is to provide a washable straw of high practicality which includes a middle connecting body, a first snap-fitting body connected with one side of the middle connecting body, and a second snap-fitting body connected with another side of the middle connecting body opposite to the first snap-fitting body. The first snap-fitting body and the second snap-fitting body may be movably connectable by snap-fitting.

Preferably, an inner side of the first snap-fitting body protrudes outwardly to form a first snap-fitting portion, and an outer side of the second snap-fitting body recesses inwardly to form a second snap-fitting portion. The first and second snap-fitting portions are configured to snap fit and connect to each other. The first and second snap-fitting portions have matching shapes, and the first snap-fitting portion is receivable in the second snap-fitting portion.

Preferably, the first snap-fitting body includes a first connecting body having one end connected with the middle connecting body and another end connected with the first snap-fitting portion. A pointed groove is formed in a connecting region of the first connecting body and the first snap-fitting portion. One side of the second snap-fitting portion is formed with a pointed protrusion which mates with the pointed groove.

Preferably, an opening region at another side of the second snap-fitting portion is an inclined surface structure, and an end tip region at an outer side of the first snap-fitting portion is integrally formed and provided with a pointed protrusion that mates with the inclined surface structure of the second snap-fitting portion.

Preferably, the second snap-fitting body is sickle-shaped, and an outer side of a front-end region of the second snap-fitting body is formed with a curved surface structure which matches a bending degree of an inner wall of the first snap-fitting body.

Preferably, an end tip region of the first snap-fitting body protrudes towards an inner side to form a first snap-fitting portion. The second snap-fitting body is in the shape of a hanging hook. An outer side of the second snap-fitting body recesses inwardly to form a second snap-fitting portion. The first and second snap-fitting portions are configured to snap fit and connect to each other. The first and second snap-fitting portions have matching shapes, and the first snap-fitting portion is receivable in the second snap-fitting portion.

Preferably, the first snap-fitting portion of the first snap-fitting body protrudes towards an inner side to form a first protrusion. A first groove is formed at a lower side of the first protrusion. Furthermore, an end tip region of the second snap-fitting body protrudes towards an inner side to form a second protrusion which mates with the first groove. Similarly, a lower side of the second protrusion is formed with a second groove which mates with the first protrusion. When the first snap-fitting body and the second snap-fitting body are connected, the first protrusion and the second protrusion are received in the second groove and the first groove respectively.

Preferably, an opening region at another side of the second snap-fitting portion opposite to the second protrusion is formed with an arc surface body structure which matches the shape of an outer wall of the first snap-fitting portion.

Preferably, a connecting portion of the second snap-fitting body and the middle connecting body is a groove-shaped structure.

Preferably, an entire body of the middle connecting body, the first snap-fitting body, and the second snap-fitting body is ear-shaped before connection.

Compared to the prior art, the present disclosure provides a washable straw of high practicality, which adopts a simultaneous setting of a middle connecting body 11, a first snap-fitting body 12 that connects with one side of the middle connecting body 11, and a second snap-fitting body 13 that connects with another side of the middle connecting body 11 opposite to the first snap-fitting body 12. Furthermore, an inner side of the first snap-fitting body 12 protrudes outwardly to form a first snap-fitting portion 123, and an outer side of the second snap-fitting body 13 recesses inwardly to form a second snap-fitting portion 133. The first and second snap-fitting portions 123, 133 are configured to snap fit and connect to each other. Since the first and second snap-fitting portions 123, 133 have matching shapes, the first snap-fitting portion 123 can be completely received in the second snap-fitting portion 133 during the connection process to form the connection. The structural design of the present disclosure is rational. Through the control of the dimensions of the various components and the elastic contraction of the material, a reliable connection and a certain degree of sealing and leak-proof effect can be achieved. Moreover, it is easy to use and wash, and has an outstanding result of application.

DETAILED DESCRIPTION OF EMBODIMENTS

In order to make the purpose, technical scheme and advantages of the present disclosure clear, the present disclosure will be further described in detail below with the combination of the drawings and embodiments. It should be understood that the specific embodiments described here are intended only to explain the present disclosure and are not used to limit the present disclosure.

Figure 1:
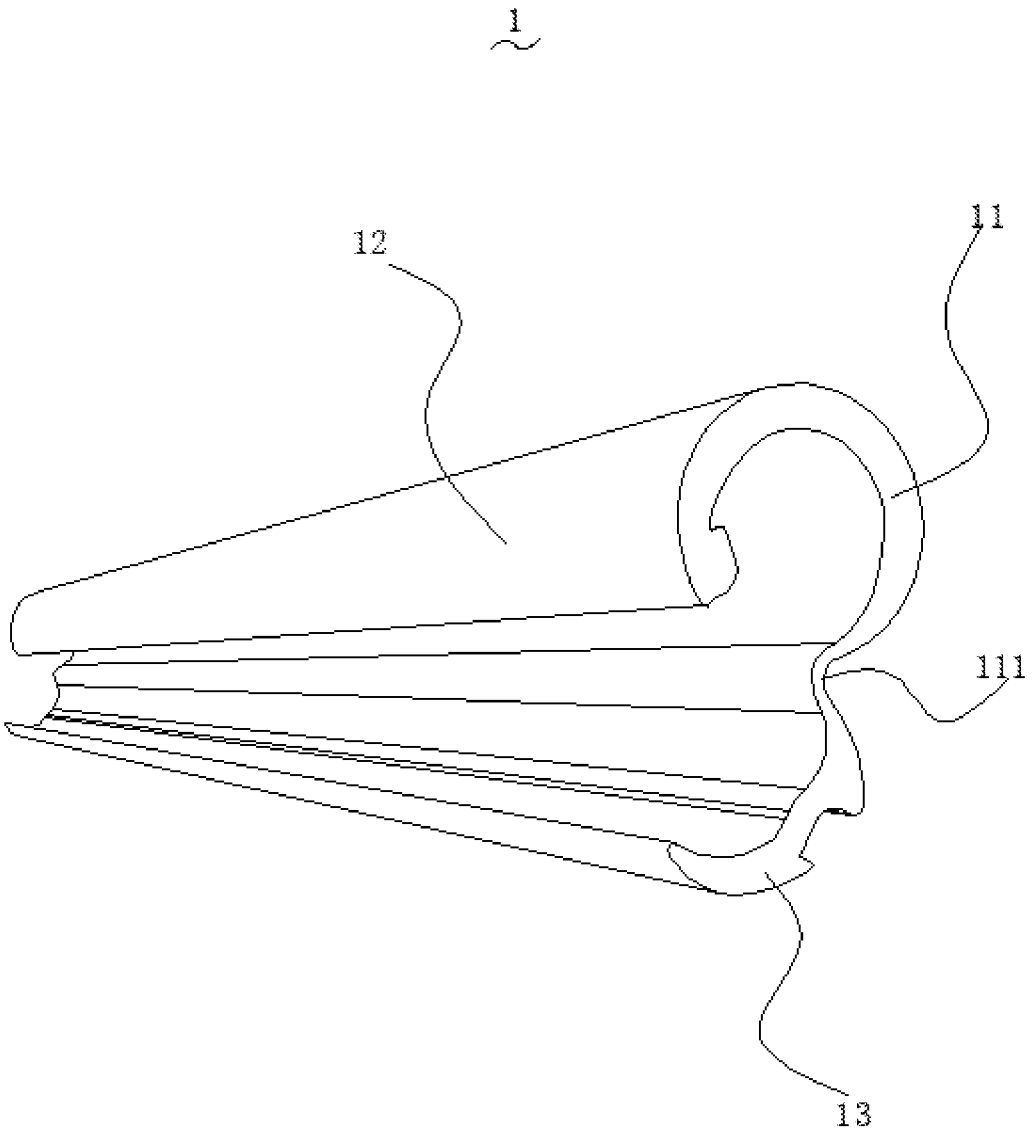
FIG. 1 is a schematic diagram showing a perspective state of the washable straw of high practicality according to a first embodiment of the present disclosure.
Figure 2:
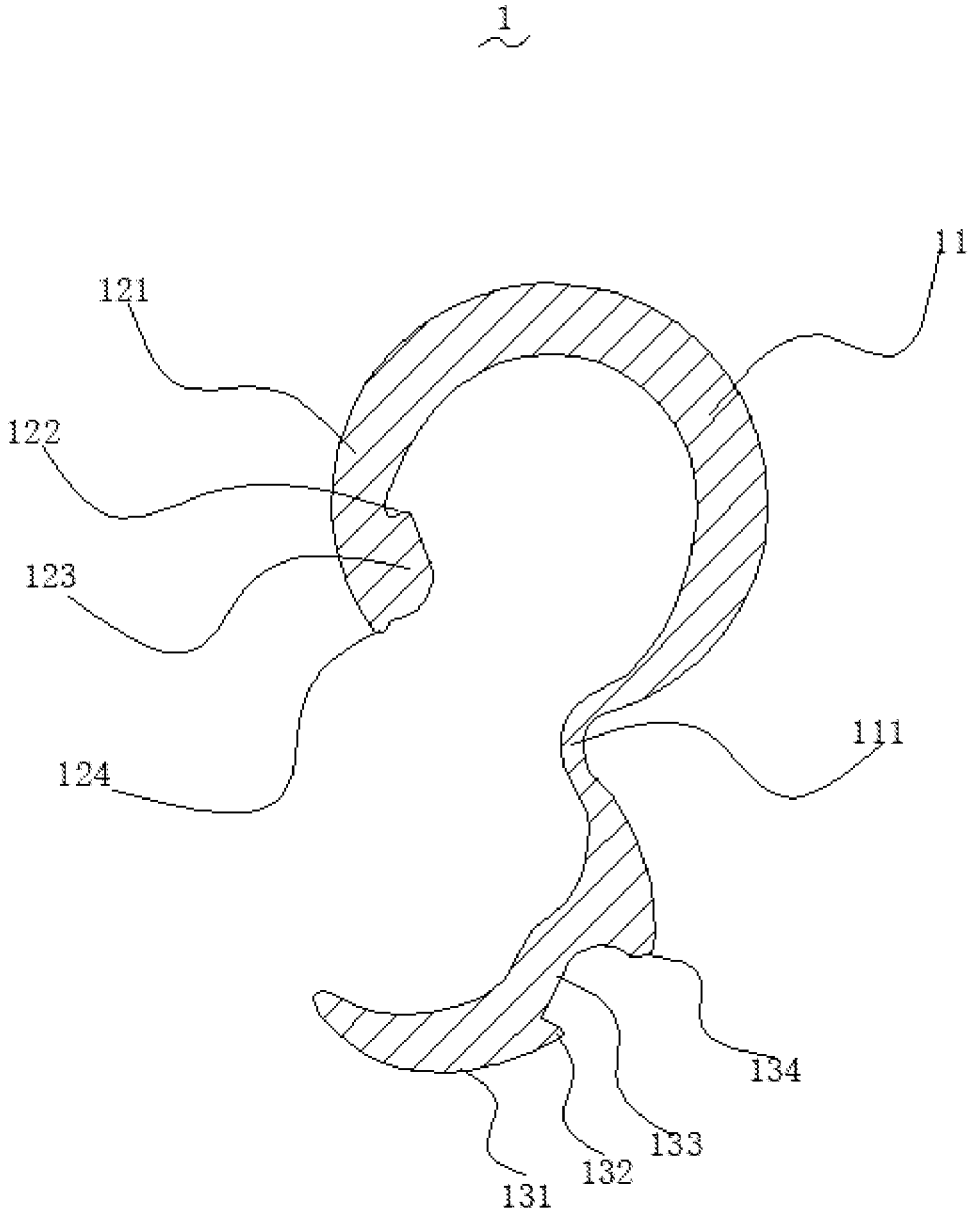
FIG. 2 is a schematic diagram showing a cross sectional state of the washable straw of high practicality according to a first embodiment of the present disclosure.
Figure 3:
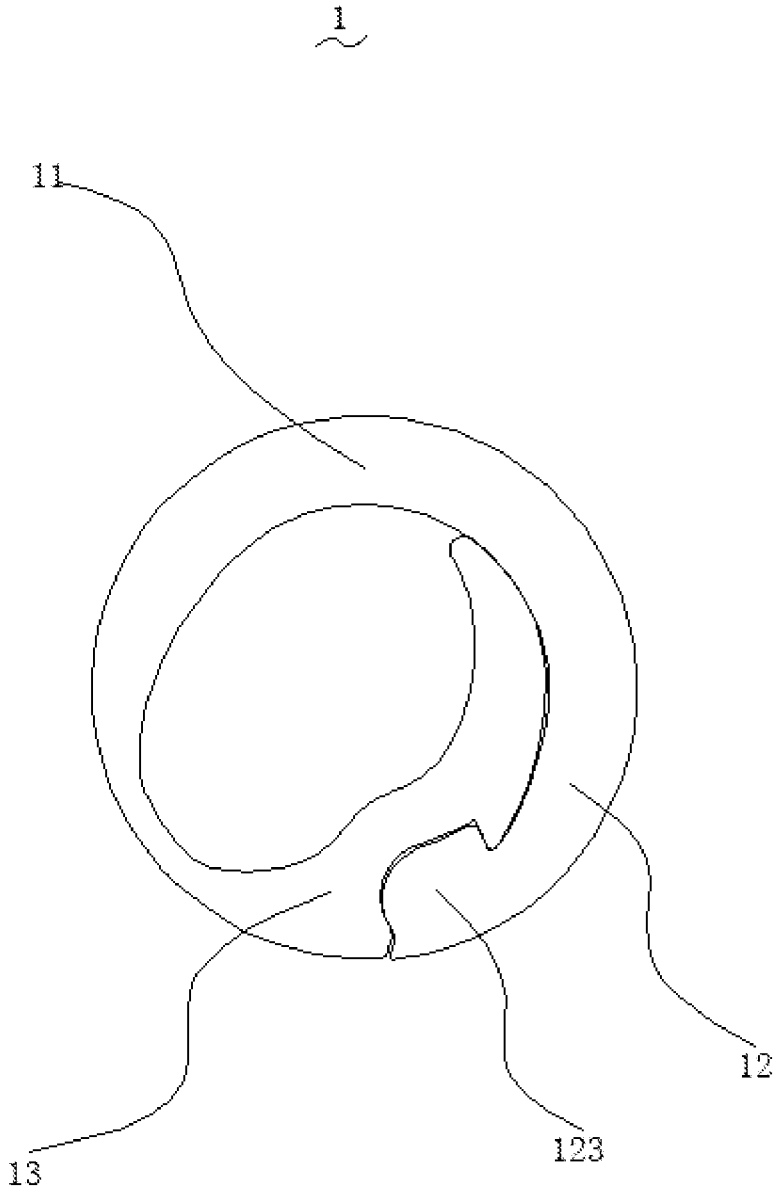
FIG. 3 is a schematic diagram showing a state of use of the washable straw of high practicality according to a first embodiment of the present disclosure.

Referring to FIGS. 1-3, a first embodiment of the washable straw of high practicality 1 of the present disclosure may include a middle connecting body 11, a first snap-fitting body 12 connected with one side of the middle connecting body 11, and a second snap-fitting body 13 connected with another side of the middle connecting body 11 opposite to the first snap-fitting body 12. An inner side of the first snap-fitting body 12 may protrude outwardly to form a first snap-fitting portion 123, and an outer side of the second snap-fitting body 13 may recess inwardly to form a second snap-fitting portion 133. The first and second snap-fitting portions 123, 133 may be configured to snap fit and connect to each other. The first and second snap-fitting portions 123, 133 may have matching shapes, and the first snap-fitting portion 123 may be receivable in the second snap-fitting portion 133.

The present application adopts a simultaneous setting of the middle connecting body 11, the first snap-fitting body 12 that connects with one side of the middle connecting body 11, and the second snap-fitting body 13 that connects with another side of the middle connecting body 11 opposite to the first snap-fitting body 12. Furthermore, an inner side of the first snap-fitting body 12 protrudes outwardly to form the first snap-fitting portion 123, and an outer side of the second snap-fitting body 13 recesses inwardly to form the second snap-fitting portion 133. The first and second snap-fitting portions 123, 133 are configured to snap fit and connect to each other. Since the first and second snap-fitting portions 123, 133 have matching shapes, the first snap-fitting portion 123 can be completely received in the second snap-fitting portion 133 during the actual connection process to form the connection. The structural design of the present disclosure is rational. Through the control of the dimensions of the various components and the elastic contraction of the material, a reliable connection and a certain degree of sealing and leak-proof effect can be achieved. Moreover, it is easy to use and wash, and has an outstanding result of application.

Preferably, the first snap-fitting body 12 may include a first connecting body 121 having one end connected with the middle connecting body 11 and another end connected with the first snap-fitting portion 123. A pointed groove 122 may be formed in a connecting region of the first connecting body 121 and the first snap-fitting portion 123. One side of the second snap-fitting portion 133 may be formed with a pointed protrusion 132 which mates with the pointed groove 122.

The structural design of the pointed groove 122 and the pointed protrusion 132 can further ensure a steady connection of the first snap-fitting body 12 to the second snap-fitting body 13.

Preferably, an opening region at another side of the second snap-fitting portion 133 may be an inclined surface structure. An end tip region at an outer side of the first snap-fitting portion 123 may be integrally formed and provided with a pointed protrusion 124 that mates with the inclined surface structure 134 of the second snap-fitting portion 133.

During the actual connecting process, the pointed protrusion 124 covers the outer side of the inclined surface structure 134. To a certain degree, this can achieve the effect of preventing the first snap-fitting portion 123 from becoming loose.

Preferably, the second snap-fitting body 13 may connect with the middle connecting body 11 through a connecting portion 111 having a thickness that is smaller than that of the middle connecting body 11 and the second snap-fitting body 13.

Preferably, the second snap-fitting body 13 may be in the shape of a sickle. An outer side of a front-end region of the sickle-shaped second snap-fitting body 13 may be formed with a curved surface structure 131 which matches a bending degree of an inner wall of the first snap-fitting body 12. The mating structure of the curved surface structure 131 and the inner wall of the first snap-fitting body 12 is advantageous in ensuring the completeness of the entire product.

Preferably, the entire body of the middle connecting body 11, the first snap-fitting body 12, and the second snap-fitting body 13 is in the shape of a cylindrical body after connection is completed.

Preferably, the middle connecting body 11, the first snap-fitting body 12, and the second snap-fitting body 13 are made of a silicone material.

Preferably, the middle connecting body 11, the first snap-fitting body 12, the second snap-fitting body 13, and the connecting portion 111 are integrally formed.

Preferably, the thickness of the connecting portion 111 is in a range of 0.5-1.5 mm.

Preferably, the end tip region of the first snap-fitting body 12 and the connecting portion 111 form an opening into which the second snap-fitting body 13 can snap.

The present disclosure is a washable straw of high practicality 1 which adopts a simultaneous setting of a middle connecting body 11, a first snap-fitting body 12 that connects with one side of the middle connecting body 11, and a second snap-fitting body 13 that connects with another side of the middle connecting body 11 opposite to the first snap-fitting body 12. Furthermore, an inner side of the first snap-fitting body 12 protrudes outwardly to form a first snap-fitting portion 123, and an outer side of the second snap-fitting body 13 recesses inwardly to form a second snap-fitting portion 133. The first and second snap-fitting portions 123, 133 are configured to snap fit and connect to each other. Since the first and second snap-fitting portions 123, 133 have matching shapes, the first snap-fitting portion 123 can be completely received in the second snap-fitting portion 133 during the connection process to form the connection. The structural design of the present disclosure is rational. Through the control of the dimensions of the various components and the elastic contraction of the material, a reliable connection and a certain degree of sealing and leak-proof effect can be achieved. Moreover, it is easy to use and wash, and has an outstanding result of application.

Figure 4:
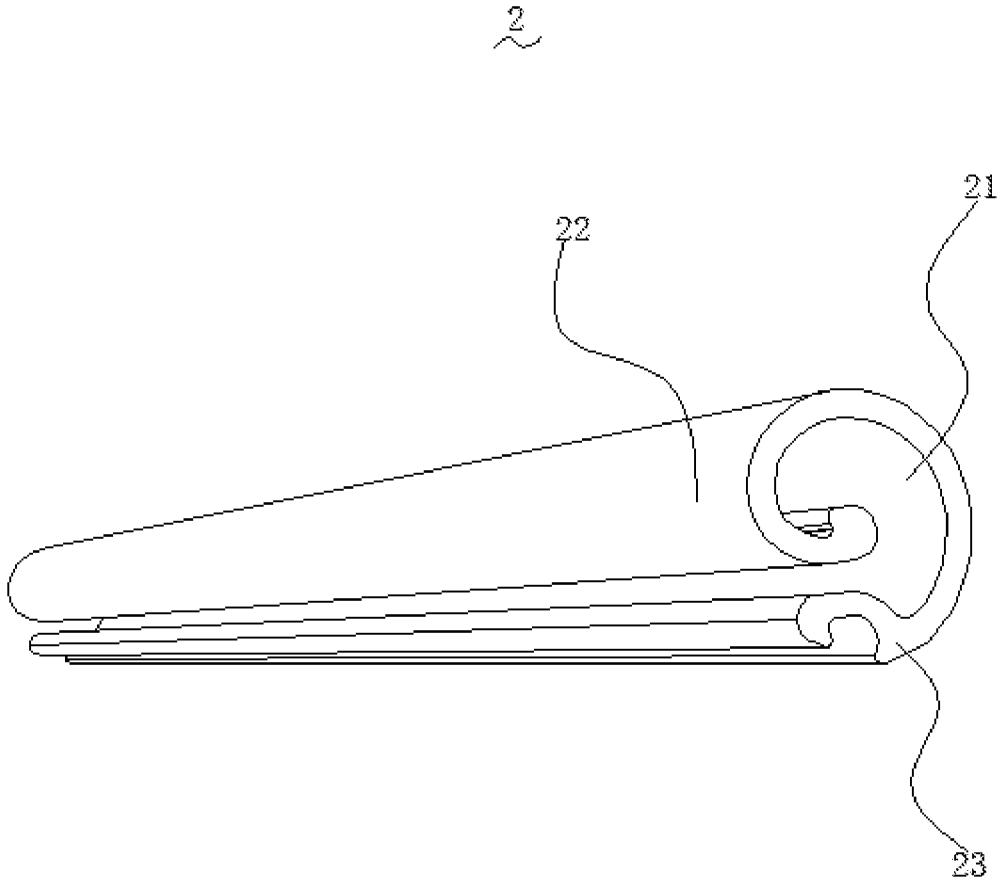
FIG. 4 is a schematic diagram showing a perspective state of the washable straw of high practicality according to a second embodiment of the present disclosure.
Figure 5:
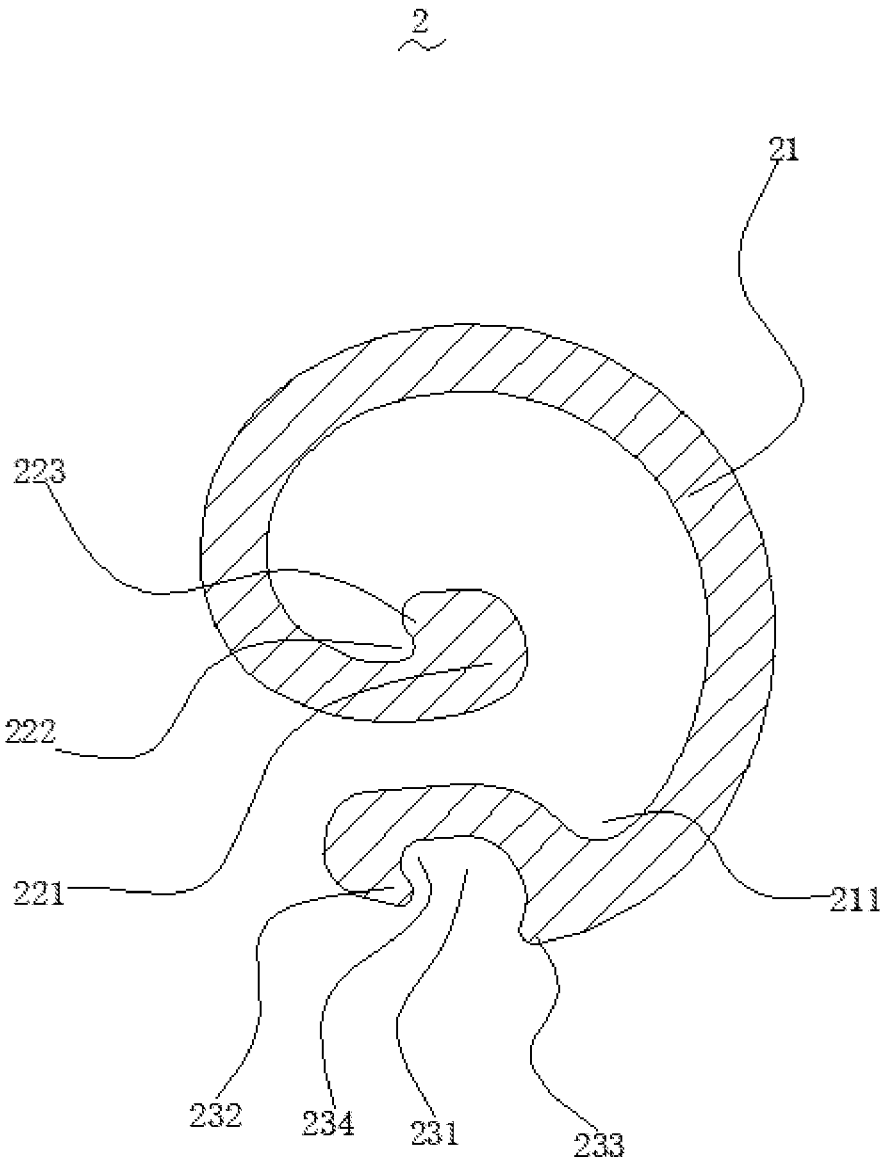
FIG. 5 is a schematic diagram showing a cross sectional state of the washable straw of high practicality according to a second embodiment of the present disclosure.
Figure 6:
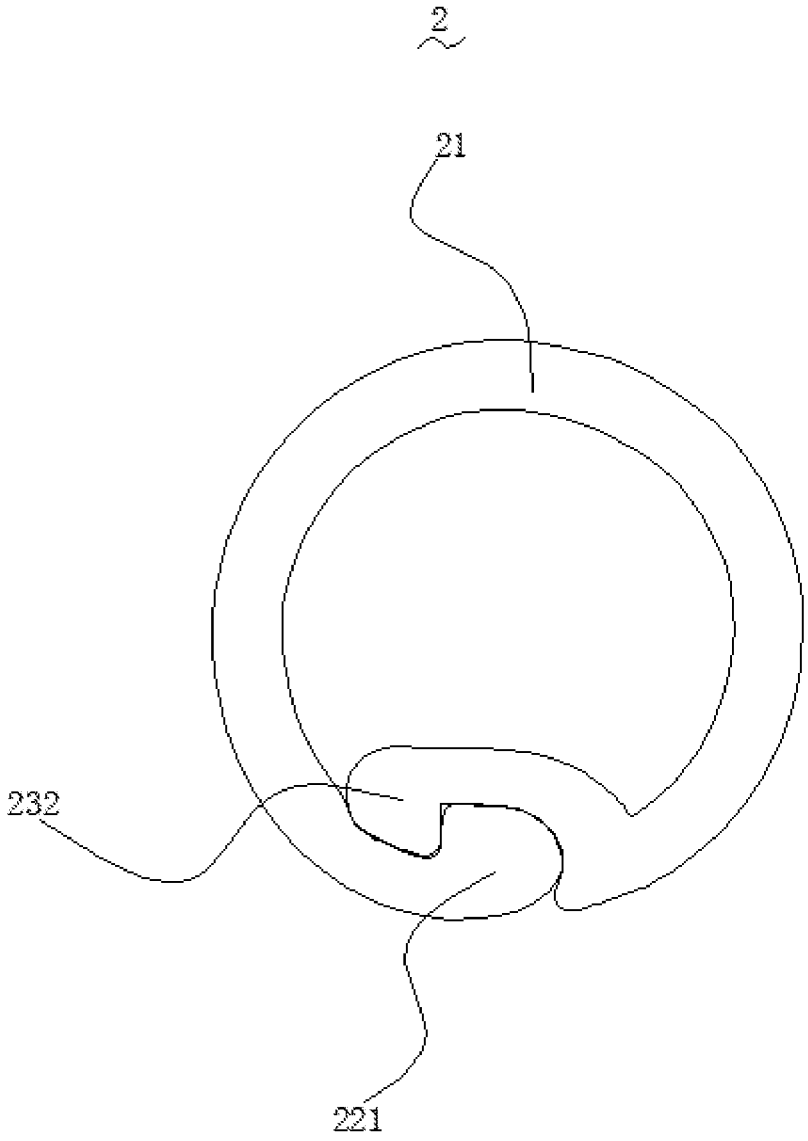
FIG. 6 is a schematic diagram showing a state of use of the washable straw of high practicality according to a second embodiment of the present disclosure.

Referring to FIGS. 4-6, a second embodiment of the washable straw of high practicality 2 of the present disclosure may include a middle connecting body 21, a first snap-fitting body 22 connected with one side of the middle connecting body 21, and a second snap-fitting body 23 connected with another side of the middle connecting body 21 opposite to the first snap-fitting body 22. An end tip region of the first snap-fitting body 22 may protrude towards an inner side to form a first snap-fitting portion 221. The second snap-fitting body 23 may be in the shape of a hanging hook. An outer side of the second snap-fitting body 23 may recess inwardly to form a second snap-fitting portion 231. The first and second snap-fitting portions 221, 231 may be configured to snap fit and connect to each other. The first and second snap-fitting portions 221, 231 may have matching shapes, and the first snap-fitting portion 221 may be received in the second snap-fitting portion 231.

The present application adopts a simultaneous setting of the middle connecting body 21, the first snap-fitting body 22 connected with one side of the middle connecting body 21, and the second snap-fitting body 23 connected with another side of the middle connecting body 21 opposite to the first snap-fitting body 22. Moreover, an end tip region of the first snap-fitting body 22 may protrude towards an inner side to form the first snap-fitting portion 221. The second snap-fitting body 23 may be in the shape of a hanging hook. An outer side of the second snap-fitting body 23 may recess inwardly to form the second snap-fitting portion 231.

The first and second snap-fitting portions 221, 231 may be configured to snap fit and connect to each other. Since the first and second snap-fitting portions 221, 231 have matching shapes, the first snap-fitting portion 221 can be completely received in the second snap-fitting portion 231 during the connection process to form the connection. The structural design of the present disclosure is rational. Through the control of the dimensions of the various components and the elastic contraction of the material, a reliable connection and a certain degree of sealing and leak-proof effect can be achieved. Moreover, it is easy to use and wash, and has an outstanding result of application.

Preferably, the first snap-fitting portion 221 of the first snap-fitting body 22 may protrude towards an inner side to form a first protrusion 223. A first groove 222 may be formed at a lower side of the first protrusion 223. Furthermore, an end tip region of the second snap-fitting body 23 may protrude towards an inner side to form a second protrusion 232 which mates with the first groove 222. Similarly, a lower side of the second protrusion 232 may be formed with a second groove 234 which mates with the first protrusion 223. When the first snap-fitting body 22 and the second snap-fitting body 23 are connected, the first protrusion 223 and the second protrusion 232 can be received in the second groove 234 and the first groove 222 respectively.

Preferably, an opening region at another side of the second snap-fitting portion 231 opposite to the second protrusion 232 may be formed with an arc surface body structure 233 which matches the shape of an outer wall of the first snap-fitting portion 221. The arc surface body structure 233 may form a wrapping over the first snap-fitting portion 221 that can further enhance the reliability of the connection.

Preferably, a connecting region of the second snap-fitting body 23 and the middle connecting body 21 may be a groove-shaped structure 211.

Preferably, the entire body of the middle connecting body 21, the first snap-fitting body 22, and the second snap-fitting body 23 may be in the shape of a cylindrical body after connection is completed.

Preferably, the middle connecting body 21, the first snap-fitting body 22, and the second snap-fitting body 23 may be made of a silicone material.

Preferably, the middle connecting body 21, the first snap-fitting body 22, and the second snap-fitting body 23 may be integrally formed.

Preferably, the thickness of the middle connecting body 21 may be in a range of 2-5 mm.

Preferably, an entire body of the middle connecting body 21, the first snap-fitting body 22, and the second snap-fitting body 23 may be ear-shaped before connection.

The present disclosure is a washable straw of high practicality 2 which adopts a simultaneous setting of the middle connecting body 21, the first snap-fitting body 22 connected with one side of the middle connecting body 21, and the second snap-fitting body 23 connected with another side of the middle connecting body 21 opposite to the first snap-fitting body 22. Moreover, an end tip region of the first snap-fitting body 22 may protrude towards an inner side to form the first snap-fitting portion 221. The second snap-fitting body 23 may be in the shape of a hanging hook. An outer side of the second snap-fitting body 23 may recess inwardly to form the second snap-fitting portion 231. The first and second snap-fitting portions 221, 231 may be configured to snap fit and connect to each other. Since the first and second snap-fitting portions 221, 231 have matching shapes, the first snap-fitting portion 221 can be completely received in the second snap-fitting portion 231 during the actual connection process to form the connection. The structural design of the present disclosure is rational. Through the control of the dimensions of the various components and the elastic contraction of the material, a reliable connection and a certain degree of sealing and leak-proof effect can be achieved. Moreover, it is easy to use and wash, and has an outstanding result of application.

The embodiments of the present disclosure described above do not constitute a limitation to the scope of protection of the present disclosure. Any modifications, equivalent replacements and improvements made within the spirit and principle of the present disclosure shall fall within the scope of protection of the claims of the present disclosure.

What is claimed is:

1. A washable straw, comprising:

a middle connecting body;

a first snap-fitting body connected with one side of the middle connecting body; and a second snap-fitting body connected with another side of the middle connecting body opposite to the first snap-fitting body, the first snap-fitting body and the second snap-fitting body being movably connectable by snap-fitting, wherein the second snap-fitting body is sickle-shaped and provided with a curved surface structure, wherein a first snap-fitting portion is formed on the first snap-fitting body, wherein a second snap-fitting portion is formed on the second snap-fitting portion, wherein the first snap-fitting body and the second snap-fitting body are coupled to form the washable straw into a tubular shape, wherein the curved surface structure extends substantially beyond the first snap-fitting body, wherein an outer surface of the curved surface structure is adjacent to an inner surface of the middle connecting body, wherein the curved surface structure overlaps with a portion of the middle connecting body; wherein the first snap-fitting body further comprising a first connecting body having one end connected with the middle connecting body and another end connected with the first snap-fitting portion, a pointed groove provided in a connecting region of the first connecting body and the first snap-fitting portion; and a pointed protrusion provided in an end tip region on an outer side of the first snap-fitting portion; wherein the second snap-fitting body further comprising a pointed protrusion provided on one side of the second snap-fitting portion, and mating with the pointed groove, and an inclined surface structure provided on another side of the second snap-fitting portion, and mating with the pointed protrusion of the first snap-fitting body; wherein a thickness of the first snap-fitting portion at a portion between the point protrusion and pointed groove is greater than a thickness at the connecting region between the first connecting body and the first snap-fitting portion.

2. The washable straw according to claim 1, wherein an inner side of the first snap-fitting body protrudes towards center of the straw to form the first snap-fitting portion, an outer side of the second snap-fitting body recesses towards center of the straw to form the second snap-fitting portion, wherein the first and second snap-fitting portions are configured to snap fit and connect to each other, the first and second snap-fitting portions have matching shapes, and the first snap-fitting portion is receivable in the second snap-fitting portion.

3. The washable straw according to claim 1, wherein the second snap-fitting body may connect with the middle connecting body through a connecting portion having a thickness that is less than that of the middle connecting body and the second snap-fitting body.

4. The washable straw according to claim 1, wherein the middle connecting body, the first snap-fitting body, and the second snap-fitting body are made of a silicone material.

5. The washable straw according to claim 1, wherein the middle connecting body, the first snap-fitting body, the second snap-fitting body, and a connecting portion are integrally formed.

6. The washable straw according to claim 5, wherein the thickness of the connecting portion is between 0.5-1.5 mm.

* * * * *